United States Patent [19]

Wang

[11] Patent Number: 5,018,951

[45] Date of Patent: May 28, 1991

[54] PORTABLE ELECTRICAL FAN

[75] Inventor: Jui-Shang Wang, Taipei, Taiwan

[73] Assignee: Duracraft Corporation, Sudbury, Mass.

[21] Appl. No.: 391,265

[22] Filed: Aug. 9, 1989

[51] Int. Cl.[5] ..... F04B 17/00; F01D 15/12; E05D 7/10; H01H 3/20

[52] U.S. Cl. ..... 417/423.15; 415/123; 16/260; 200/330; 200/566

[58] Field of Search ..... 417/423.1, 423.15; 415/123; 200/43.01, 43.11, 43.13, 318.2, 329, 336–341, 345, 564, 566, 326, 330, 318, 318.1, 321, 43.16, 43.18, 43,19, 43.21; 416/246; 16/260, 332, 344, 345, 349; 366/300, 301, 198

[56] References Cited

U.S. PATENT DOCUMENTS

| | | | |
|---|---|---|---|
| 2,810,050 | 10/1957 | Johnson | 200/318.1 |
| 2,937,535 | 11/1958 | Wezner | 200/330 |
| 3,904,178 | 9/1975 | Scott et al. | 366/199 |
| 3,965,755 | 6/1976 | Rosenberg et al. | 200/6 |
| 3,973,097 | 8/1976 | Rosenberg et al. | 200/153 |
| 4,123,633 | 10/1978 | Stevens et al. | 200/61.86 |
| 4,334,132 | 6/1982 | Poole | 200/153 |
| 4,732,539 | 3/1988 | Shin-Chin | 416/246 |

*Primary Examiner*—Leonard E. Smith
*Assistant Examiner*—John A. Savio, III
*Attorney, Agent, or Firm*—John E. Toupal; Harold G. Jarcho

[57] ABSTRACT

A portable electric appliance including a fan device comprising a rotatable blade assembly and an electrical motor operatively coupled thereto; a standard having an upper end fixed to the fan device; a pedestal base; a coupling including an upper member joined to a lower end of the standard and a lower member pivotally coupled with the upper member and joined to the pedestal, the upper member being freely demountable from the lower member; a manually operable latch for preventing demounting of the upper member from the lower member; and a positioning mechanism for selectively fixing the relative angular positions of the upper and lower members.

38 Claims, 3 Drawing Sheets

PORTABLE ELECTRICAL FAN

BACKGROUND OF THE INVENTION

This invention relates generally to a portable electric appliance, and more specifically, to a portable electric fan.

Portable electrical fans are utilized to create air flow and thereby enhance environmental conditions. To optimize the flow patterns produced thereby, many portable fans are provided with supports that permit selective orientation of a fan member on a supporting pedestal. Although various types of fan supports have been proposed, prior support mechanisms suffer from a number of individual and collective disadvantages such as high cost, cumbersome assembly and adjustment requirements, insufficient orientation adjustment capability, etc. In addition prior fans have sometimes caused personal injury after being inadvertently actuated by small children.

The object of this invention, therefore, is to provide an improved inexpensive electrical fan that is both safe and simple to assemble and operate.

SUMMARY OF THE INVENTION

The invention is a portable electric appliance including a fan device comprising a rotatable blade assembly and an electrical motor operatively coupled thereto; a standard having an upper end fixed to the fan device; a pedestal base; a coupling including an upper member joined to a lower end of the standard and a lower member pivotally coupled with the upper member and joined to the pedestal, the upper member being freely demountable from the lower member; a manually operable latch for preventing demounting of the upper member from the lower member; and a positioning mechanism for selectively fixing the relative angular positions of the upper and lower members. The latch and positioning mechanism simplify use and assembly of the appliance.

According to one feature of the invention, the lower member comprises an integrally formed upright portion of the pedestal, and the upper member comprises an integrally formed lower portion of the standard means. This arrangement reduces the cost by minimizing required parts.

According to other features of the invention, the lower member defines a yoke portion, the upper member defines a pin portion pivotally received by the yoke portion; the latch comprises a catch movable between a latching position engaging the pin portion so as to prevent said demounting of said upper member and a release position allowing demounting; the catch is biased into its latching position; and the latch is integrally formed with the lower member and comprises a flexible, resilient arm portion manually operable to move the catch into its release position. Combining of the multiple functions in single components further reduces cost.

According to other features of the invention, the upright portion defines the yoke portion, the upper member defines a cavity open on one side and at a bottom end, the cavity receives and substantially encloses the upright portion, and the pin portion is disposed in the cavity. This arrangement enhances both operation and appearance of the device.

According to still other features of the invention, the upright portion has a pair of side walls; the yoke portion comprises a pair of yokes, one formed by a slot in an upper edge of each of the side walls; the pin portion comprises a pair of axially aligned pins having inner ends separated and outer ends extending, respectively, from opposing surfaces of the cavity; each of the pins is pivotally supported by a different one of the yokes; the upright portion comprises front and rear walls joining the side walls; the arm portion is formed on an upper end of the rear wall; and the catch extends from the arm portion into regions between the slots when in the latched position. Further economy of parts and efficiency of operation are provided by these features.

According to yet other features of the invention, the positioning mechanism comprises a plurality of lower teeth on a flexible, resilient rack having one free end and an opposite end fixed to the pedestal means and an upper tooth formed on the lower end of the upper member; and wherein the rack is biased in a position providing engagement between the upper tooth and one of the lower teeth determined by the relative angular position between the upper and lower members, and the free end of the rack can be manually actuated to eliminate engagement and thereby allow relative pivotal movement between the upper and lower members. This assembly facilitates angular adjustment of the fan with inexpensive compact parts.

According to an important feature of the invention, the appliance includes a safety electrical switch for controlling the flow of current to the motor, the switch movable between an on position in which current is supplied and on off position in which current flow is interrupted; and an actuator manually movable in one sense between active and inactive positions, the actuator in its active position being coupled to the switch and manually movable in a different sense than the one sense to move the switch between said on and off positions, and the actuator in its inactive position being decoupled from the switch so as to be incapable of producing movement thereof between its on and off positions. The actuator prevents inadvertent actuation of the fan by small children.

According to another important feature, the device includes a bias means biasing the actuator in its inactive position, and a latch manually operable to overcome the bias means and latch the actuator means in its active position. The latch enables a user to deactivate the safety switch when desired.

According to other features, the actuator comprises a first annular gear member keyed to the switch and rotatable to produce movement thereof between its on and off positions, a second annular gear member movable in a linear sense between its active and inactive positions, and the first and second gears are axially spaced apart with the second member in its inactive position and are operatively engaged with the second member in said active position. This arrangement provides the desired safety functions in a compact assembly.

According to yet other features, the second member is cup-shaped with an end wall and a side wall defining an open ended chamber; the second gear projects from a central portion of the end wall into the chamber; the end wall defines openings extending outwardly from the central portion; and the latch comprises a button member rotatable between latched and release positions, the button member having an inner surface engaging an outer surface of the end wall and spaced apart projections extending from the inner surface through the openings, the projections have ends secured to the base so as to prevent axial motion of the bottom relative thereto while permitting rotary motion relative thereto, and the button member further defines a stop adapted with the button in its latched position and the second member in its active position to be in engagement therewith and thereby prevent return by the bias means of the second member to its inactive position. The button member provides in a simple mechanism the desired safety function inactivation.

According to an additional feature, the first gear comprises an outwardly projecting arcuate indicator portion, the base defines an arcuate wall portion covering the indicator portion, and the arcuate wall portion defines spaced apart holes aligned with the indicator portion such that rotational movement of the indicator portion is visible through the holes. Switch position indications are inexpensively provided by this arrangement.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
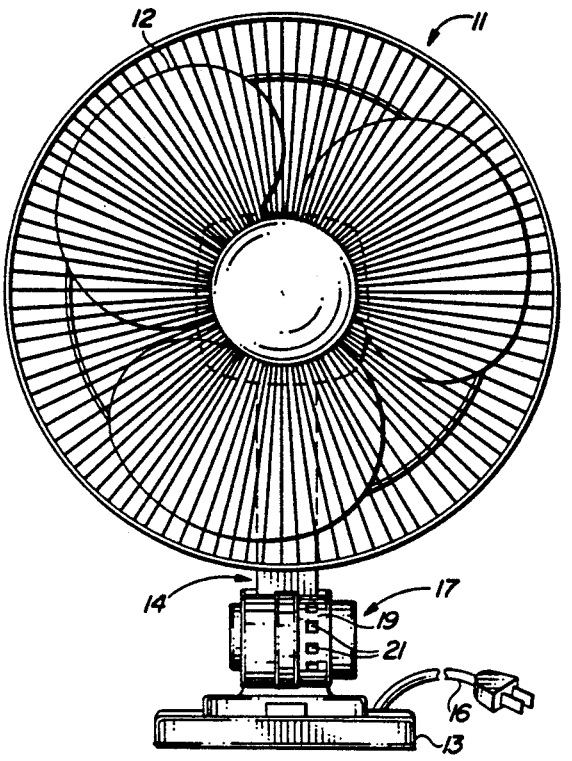
FIG. 1 is a front elevational view of a portable fan according to the invention.
Figure 2:
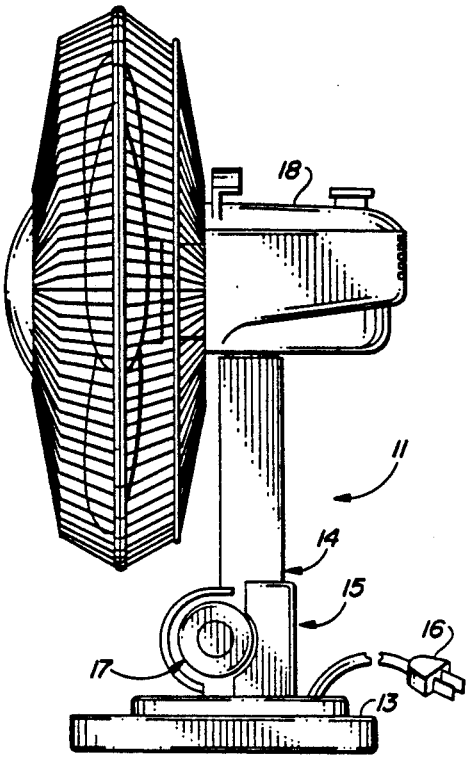
FIG. 2 is a side elevational view of the portable fan shown in FIG. 1.

A portable electric fan 11 in accordance with the invention is shown in FIGS. 1 and 2. A blade assembly 12 is supported from a pedestal base 13 by a standard 14. Joining the bottom end of the standard 14 and the pedestal 13 is a coupling 15. An electrical power cord 16 is connected by a switch assembly 17 to an electrical motor 18 operatively coupled to the blade assembly 12. Directly adjacent to the switch assembly 17 is an arcuate indicator portion 19 of the coupling 15 that defines a plurality of spaced apart holes 21.

Figure 3:
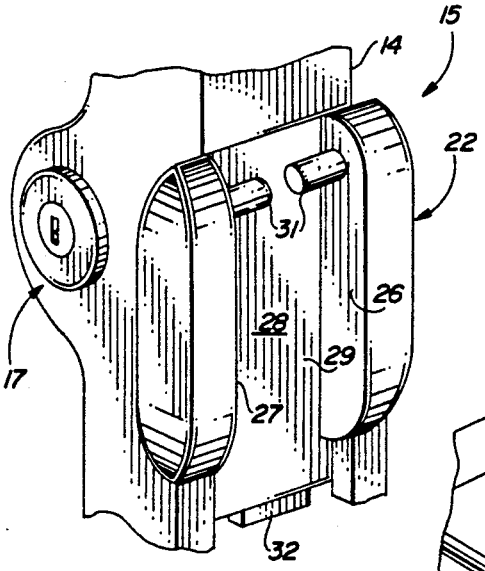
FIG. 3 is a perspective view of an upper member of a coupling shown in FIGS. 1 and 2.
Figure 4:
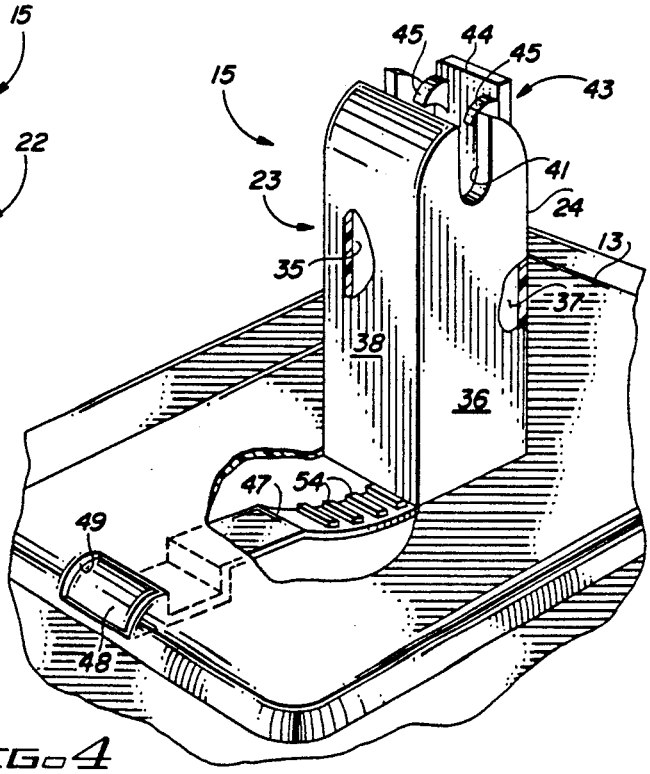
FIG. 4 is a perspective view of a pedestal portion of the fan shown in FIGS. 1 and 2.

The coupling 15 comprises an upper member 22 integrally formed as a lower portion of the standard 14 (FIG. 3) and a lower member 23 integrally formed as an upright portion 24 of the pedestal 13 (FIG. 4). The upper member 22 retains the switch assembly 17 and is pivotally supported by the lower member 23 (FIG. 5) so as to permit relative angular movement of the standard 14 relative to the pedestal 13. Defined in a back surface of the upper member 22 by side walls 26, 27 and a rear wall 28 is a cavity 29. A pair of axially aligned pins are disposed within the cavity 29 and have spaced apart inner ends and outer ends extending, respectively, from the side walls 26, 27. Formed on a lower end of the upper member 22 is a tooth 32 that comprises part of a positioning mechanism for selectively establishing a desired relative angular position between the standard 14 and the pedestal 13.

Figure 5:
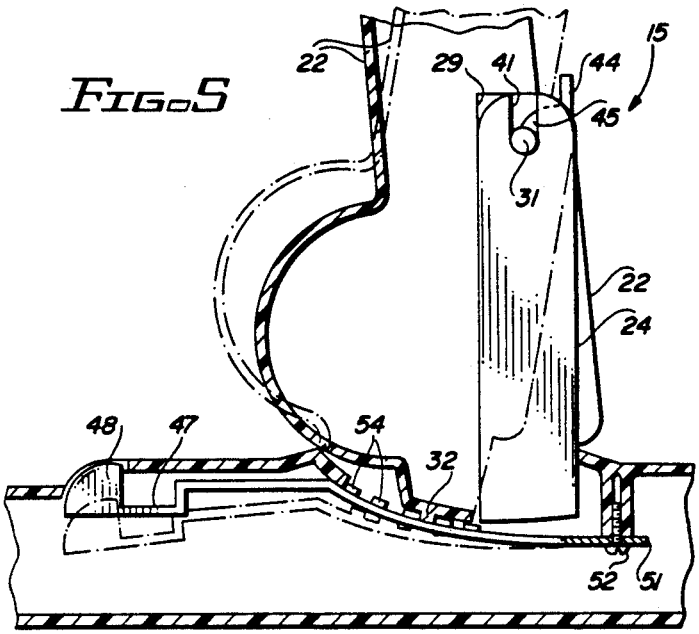
FIG. 5 is a partial cross sectional view of a coupling portion of the fan shown in FIGS. 1 and 2.

The upright portion 24 (FIG. 4) of the coupling member 23 is a hollow column having side walls 35, 36, a rear wall 37 and a front wall 38. Formed in the upper end of each side wall 35, 36 is a slot 41 that functions as a supporting yoke for one of the pins 31 in the upper member 22. A latch mechanism 43 is formed on the upper end of the rear wall 37 and includes a flexible, resilient arm portion 44 having one end projecting from the rear wall 37 and a bifurcated free end forming latch surfaces 45. Retained within the pedestal 13 is a flexible resilient rack gear 47 that forms an additional portion of the positioning mechanism noted above. The rack 47 has one free end 48 accessible through an opening 49 in the top surface of the pedestal 13 and an opposite end 51 fixed to the pedestal 13 by a screw 52 (FIG. 5). Formed on an upper surface of the rack 47 are a plurality of spaced apart lower teeth 54, each adapted for engagement with the upper tooth 32 in a different angular position of the upper member 22 relative to the lower member 23.

To mount the standard supported blade assembly 12 on the pedestal 13, the upright portion 24 is inserted into the cavity 29 of the upper member 22 such that the pins 31 are pivotally supported by the lower portions of the slotted yokes 41. During this assembly procedure, the catch surfaces 45 are forced outwardly allowing the pins 31 full access to the slots 41. However, after full entry of the pins 31 into engagement with the lower portions of the slots 41, the flexible arm portion 44 moves inwardly into its normal position wherein the catch surfaces 45 engage upper surfaces of the pins 31 to prevent separation of the upper member 22 from the lower member 23. When separation is desired, the arm portion 44 is flexed outwardly removing the catch surfaces 45 from the region between the slots 41 and thereby allowing the upper member 22 to be withdrawn from the lower member 23. With the upper member 22 mounted on the lower member 23, the side walls 35, 36 and end wall 38 of the upright portion 24 are concealed within the cavity 29.

To establish a desired angular position of the standard 14 and blade assembly 12 with respect to the pedestal 13, the upper member 22 is pivoted on the lower member 23 as shown by dashed lines in FIG. 5. The angular adjustment of the standard 14 requires the exertion of a downward force on the free end 48 to flex the rack 47 downwardly and disengage the upper tooth 32 from the lower teeth 54 as shown also by dashed lines in FIG. 5. Once a desired angular position has been established, the free end 48 is released allowing the rack 54 to spring upwardly into its normal position and engaging the upper tooth 32 between a pair of the lower teeth 54 thereby preventing further relative angular movement between the upper member 22 and the lower member 23.

Figure 6:
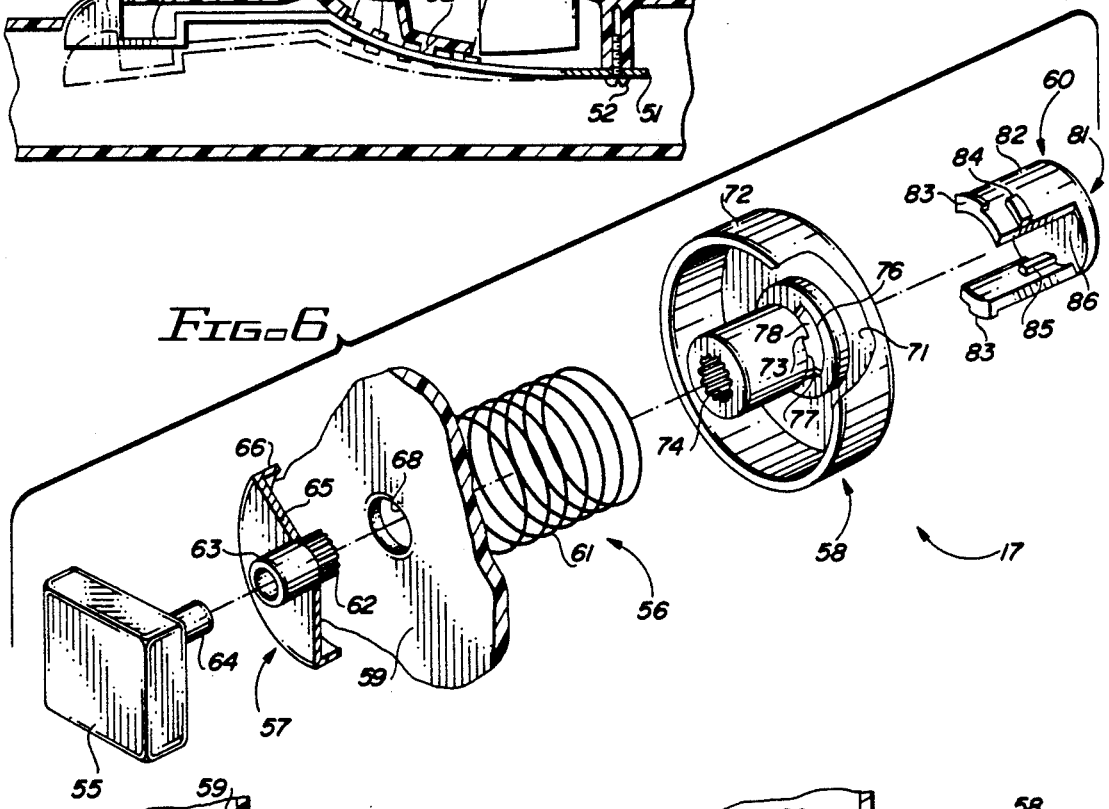
FIG. 6 is an exploded perspective view of a switch mechanism of the fan shown in FIG. 1.

Referring now to FIG. 6, there is shown in detail the switch assembly 17 that includes a conventional on-off activator switch 55 and an actuator mechanism 56 therefor. The actuator mechanism 56 includes a first member 57, a second member 58, a base portion 59 of the upper member 22, a bias spring 61 and a button latch member 60. The first member 56 has a first annular gear 62 with outwardly directed gear teeth and an axially aligned tubular portion 63 that receives and is keyed for rotation with an operating shaft 64 of the switch 55. Extending outwardly from the tubular portion 63 is a wall 65 that terminates with an arcuately shaped indicator flange portion 66 visible through the holes 21 in the actuator indicator portion 19 so as to indicate the position of the first actuator member 57 with respect to the base portion 59. The base portion 59 has a centrally located circular aperture 68. Retained between the base portion 59 and the second member 58 under compression is the bias spring 61. The second member 58 is cup-shaped with an end side wall 71, and a cylindrical wall 72. Extending from a central inner surface portion of the end wall 71 is an internal cylindrical hub portion 73 terminating at its outer end with a second annular gear 74 having inwardly directed teeth that mesh with the gear 62. A pair of openings 76 are formed in the end wall 71 on opposite sides of the hub portion 73. Formed in the base of the hub portion 73 are a relatively elongated axially directed slot 77 and a shorter slot 78 circumferentially spaced from and intersecting the elongated slot 77.

The button member 60 includes a circular wall portion 81 and axial projections 82 extending normally from an outer edge thereof. Formed at the outer end of each projection 82 is an outwardly directed outer tapered nipple 83 and an outwardly directed inner nipple 84 spaced inwardly thereof. Also formed at the base of each projection 82 is an inwardly directed stop 85. During assembly of the actuator 56, the projections 82 of the button member 60 are inserted sequentially through the openings 76 in the second member 58 and the aperture 68 in the base portion 59. During the final sequence of that assembly procedure, an inner surface 86 of the wall portion on the button 60 engages an outer surface of the end wall 71 on the second member 58 to compress the bias spring 61 between the base portion 59 and the inner surface of the end wall 71. In addition, during movement of the outer tapered nipples 83 through the circular aperture 68, the projections 82 are flexed inwardly and after full penetration flex outwardly to move the outer nipples 83 into their normal positions in which they engage an inner surface of the base portion 59, the opposite surface of which is engaged by the inner nipples 84.

Figure 7:
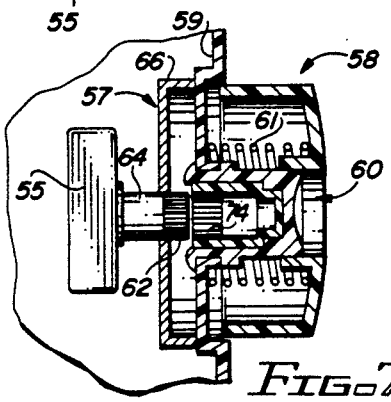
FIG. 7 is a cross sectional view of the switch shown in FIG. 6.
Figure 8:
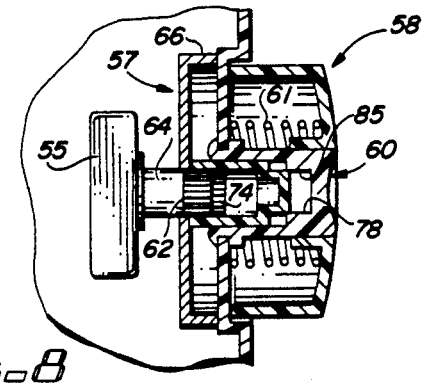
FIG. 8 is a cross sectional view similar to that shown in FIG. 7 but with the switch in a different operating position.

Operation of the switch assembly 17 will be described with reference to FIGS. 7 and 8. With the second member 58 in an inactive position shown in FIG. 7, the first gear 62 is axially spaced from and thereby disengaged from the second annular gear 74. Thus, rotary motion imparted to the second member 58 is not transferred to the first member 57 or to the operating shaft 64 of switch 55. When switch activation is desired, however, the second member 58 is pushed linearly inwardly into an active position shown in FIG. 8. In its active position, the first gear 62 is received by and engaged with the second gear 74 so that rotary motion imparted to the second member 58 is transferred through the first member 57 to the shaft 64 resulting in selected movement of the switch 55 between the on and off positions. Upon release of the second member 58, force exerted by the bias spring 61 moves the second member 58 back into its inactive position shown in FIG. 7.

Figure 9:
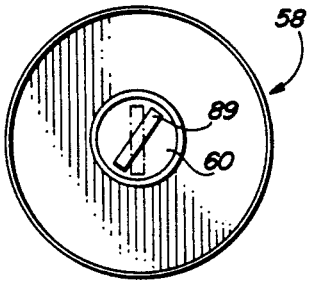
FIG. 9 is a partial front view of the switch shown in FIGS. 6–8.

In the event that the operational safety provided by the actuator mechanism 56 is not desired, the button member 60 is actuated from a release position to a latched position that maintains the second member 58 in its active position. With the button member 60 in its release position shown in FIG. 7, the stop 85 moves freely within the elongated slot 77 during axial movement of the second member 58 between its active and inactive positions. However, with the second member 58 in its active position shown in FIG. 8, the button member 60 can be rotated by a screwdriver or the like inserted into the slot 89 (FIG. 9). Rotation of the button member 60 moves the stop 85 into the narrow slot 78 as shown in FIG. 8. The engagement between the stop 85 and an inner surface of the narrow slot 78 prevents return of the second member 58 to its inactive position shown in FIG. 7. Thus, activation of the switch 55 by rotation of the second member 58 does not require in this case any inward linear movement of the second member 58.

Figure 11:
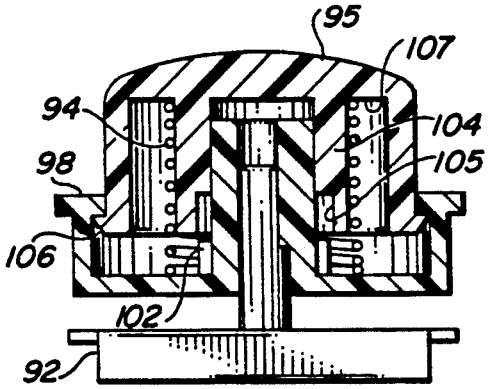
FIG. 11 is a cross sectional view of the switch shown in FIG. 10.
Figure 12:
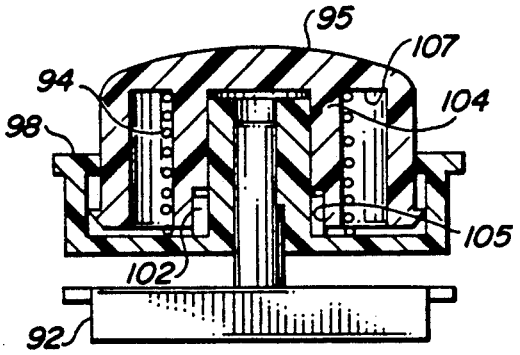
FIG. 12 is a cross sectional view similar to that shown in FIG. 11 but with a switch in a different operating position.
Figure 10:
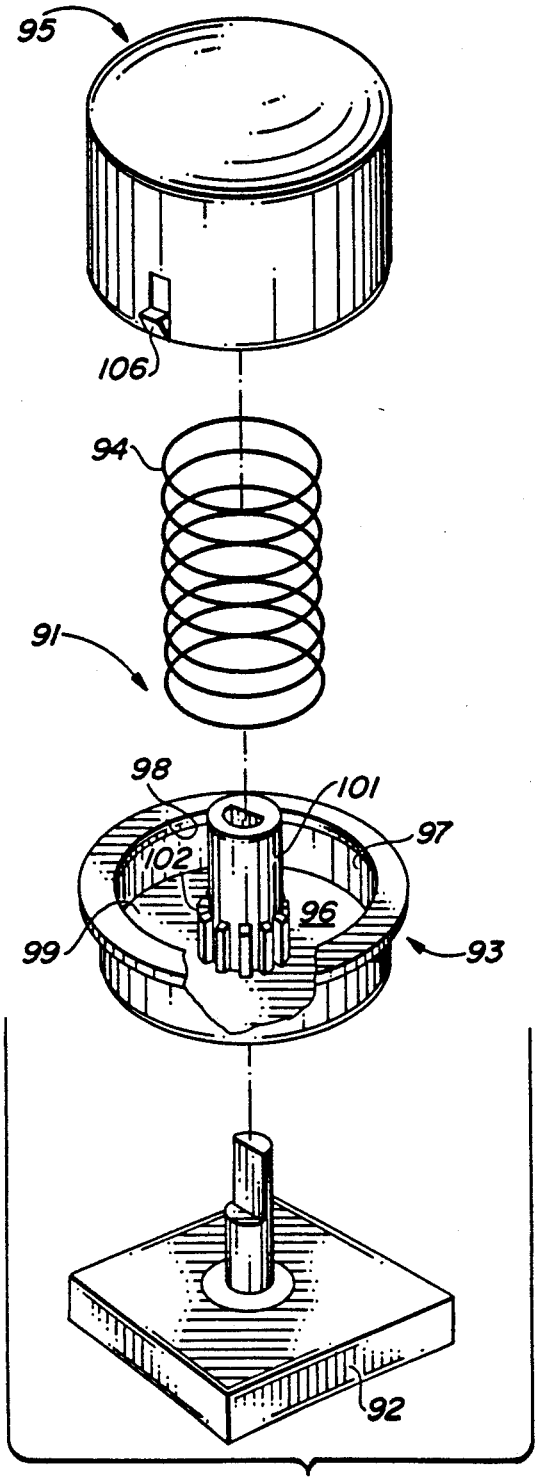
FIG. 10 is an exploded perspective view of a modified switch embodiment.

Referring now to FIGS. 10–12 there is shown another switch assembly embodiment 81 including an on-off switch 92, a first member 93, a bias spring 94 and a second member 95. The first member 93 is cup-shaped with an end wall 96 and a cylindrical side wall 97 terminating with an inwardly directed flange 98 that together define a chamber 99. Projecting into the chamber 99 from a central portion of the end wall 96 is an annular gear 102 with outwardly directed teeth and a hollow cylindrical extension thereon. The second member 95 also is cup-shaped with a centrally located inner tube portion 104 terminating with a second annular gear 105 having inwardly directed teeth. Projecting outwardly from a lower edge of the second member 95 are diametrically spaced apart, outwardly directed tabs 106. During assembly, the tabs 106 are flexed under the flange 98 as the second member 95 is inserted into the chamber 99 of the first member 93. The bias spring is retained under compression between inner surfaces of the end wall 96 and an end wall 107 of the second member 95.

With the second member 95 in an inactive position shown in FIG. 11, the second gear 105 is axially spaced and disengaged from the first gear 102. Thus, rotary motion of the second member 95 is not transmitted to the first member 93 or to an operating shaft 108 of the switch 92 keyed within the tubular portion 101. Upon linear inward movement of the second member 95 into an active position shown in FIG. 12, however, the teeth on the second gear 105 engage the teeth on the first gear 102. Subsequent rotary motion of the second member 95, therefore, is transmitted to both the first member 93 and the shaft 108 to thereby operate the switch 92.

Obviously, many modifications and variations of the present invention are possible in light of the above teachings, It is to be understood, therefore, that the invention can be practiced otherwise than as specifically described.

What is claimed is:

1. A portable electric appliance comprising:

fan means comprising a rotatable blade assembly, and an electrical motor operatively coupled to said blade assembly;

standard means having an upper end fixed to said fan means;

pedestal means;

coupling means comprising an upper member joined to a lower end of said standard means and a lower member pivotally coupled with said upper member and joined to said pedestal means, said upper member being freely demountable from said lower member;

manually operable latch means for preventing demounting of said upper member from said lower member; and positioning means for selectively fixing the relative angular positions of said upper and lower members, said positioning means comprising a first surface means defined by said pedestal, a second surface means defined on a lower end of said upper member and engageable with said first surface means in any of a plurality of relative angular positions between said upper and lower members so as to prevent pivotal movement therebetween.

2. An appliance according to claim 1 wherein said first surface means comprises surfaces on a plurality of lower teeth on a flexible, resilient rack having one free end and an opposite end fixed to said pedestal means; and said second surface means comprises an upper tooth formed on said lower end of said upper member.

3. An appliance according to claim 2 wherein said rack is biased in a position providing engagement between said upper tooth and one of said lower teeth determined by the relative angular position between said upper and lower members, and said free end of said rack can be manually actuated to eliminate said engagement and allow relative pivotal movement between said upper and lower members.

4. An electrical appliance comprising:

base means;

electrical load means mounted on said base means;

power cord means for supplying electrical current to said load means;

electrical switch means for controlling the flow of said current to said load means, said switch means movable between an on position in which said current is supplied and on off position in which said current is interrupted;

actuator means manually movable in one sense between active and inactive positions, said actuator means in said active position being coupled to said switch means and manually movable in a different sense than said one sense to move said switch means between said on and off positions, and said actuator means in said inactive position being decoupled from said switch means so as to be incapable of producing movement thereof between said on and off positions; and bias means biasing said actuator means in said inactive position.

5. An appliance according to claim 4 wherein said load means comprises a fan.

6. An appliance according to claim 4 or 5 wherein said one sense of movement is linear, and said different sense of movement is rotational.

7. An appliance according to claim 6 wherein said actuator means comprises a first member keyed to said switch and rotatable to produce movement thereof between said on and off positions, a second member movable in said linear sense between said active and inactive positions, and said second member in said active position is keyed to said first member and rotatable to produce said rotatable movement thereof and in said inactive position is decoupled from said first member so as to be incapable of producing said rotatable movement thereof.

8. An appliance according to claim 7 wherein said first member comprises a first annular gear, said second member comprises a second annular gear, said first and and second gears are axially spaced apart with said second member in said inactive position and are operatively engaged with said second member in said active position.

9. An appliance according to claim 8 wherein said first member is cup-shaped with an end wall and a cylindrical side wall defining an open ended chamber, said first gear projects from said end wall into said chamber, an outer edge of said side wall defines an inwardly directed flange, said second member is a cylindrical member axially movable within said chamber and having an outwardly directed tab extending under said flange so as to retain said second member in said chamber, and said bias means is a spring extending between said end wall and said second member.

10. An appliance according to claim 4 including latch means manually operable to overcome said bias means and latch said actuator means in said active position.

11. An appliance according to claim 10 wherein said movable means comprises a fan.

12. An appliance according to claim 10 or 11 wherein said one sense of movement is rotational, and said different sense of movement is linear.

13. An appliance according to claim 12 wherein said actuator means comprises a first member keyed to said switch and rotatable to produce movement thereof between said on and off positions, a second member movable in said linear sense between said active and inactive positions, and said second member in said active position is keyed to said first member and rotatable to produce said rotatable movement thereof and in said inactive position is decoupled from said first member so as to be incapable of producing said rotatable movement thereof.

14. An appliance according to claim 13 wherein said first member comprises a first annular gear, said second member comprises a second annular gear, said first and second gears are axially spaced apart with said second member in said inactive position and are operatively engaged with said second member in said active position.

15. An appliance according to claim 14 wherein said second member is cup-shaped with an end wall and a side wall defining an open ended chamber; said second gear projects from a central portion of said end wall into said chamber; said end wall defines openings extending outwardly from said central portion; and said latch means comprises a button member rotatable between latched and release positions, said button member having an inner surface engaging an outer surface of said end wall and spaced apart projections extending from said inner surface through said openings, said projections having ends secured to said base means so as to prevent axial motion of said button relative thereto while permitting rotary motion relative thereto, and said button member further defining stop means adapted with said button in said latched position and said second member in said active position to be in engagement therewith and thereby prevent return by said bias means of said second member to said inactive position.

16. An appliance according to claim 15 wherein said base means defines wall portion having a circular aperture, said projections extend through said aperture and have axially spaced apart outwardly directed nipples that engage opposite sides of said wall portion, and said stop means comprises inwardly directed ear means on said projections and adapted with said button member in said latched position to engage said second member and thereby prevent its movement to said inactive position.

17. An appliance according to claim 16 wherein said second gear is formed on a cylindrical portion of said second member projecting from said central portion; and said cylindrical portion defines and elongated slot that accommodates said linear movement of said ear means with said button member in said release position and a slot shorter than said elongated slot, circumferentially spaced therefrom, and intersected therewith; said shorter slot having a surface that engages said ear means with said button member in said latched position.

18. An appliance according to claim 14 wherein said first gear comprises an outwardly projecting arcuate indicator portion, said base means defines an arcuate wall portion covering said indicator portion, and said arcuate wall portion defines spaced apart holes aligned with said indicator portion such that rotational movement of said indicator portion is visible through said holes.

19. A portable electric appliance comprising:

fan means comprising a rotatable blade assembly, and an electrical motor operatively coupled to said blade assembly;

standard means having an upper end fixed to said fan means;

pedestal means;

coupling means comprising an upper member having a pin portion and joined to a lower end of said standard means and a lower member joined to said pedestal means and defining a yoke portion pivotally coupled with said pin portion so as to render said upper member freely demountable from said lower member; and manually operable latch means for preventing demounting of said upper member from said lower member; said latch means comprising catch means movable between a latching position engaging said pin portion so as to prevent said demounting of siad upper member and a release position allowing said demounting, said catch means being biased into said latching position; and wherein said latch means is integrally formed with said lower member as a single piece and comprises a flexible, resilient arm portion manually operable to move said catch means into said release position.

20. An appliance according to claim 19 wherein said lower member comprises an integrally formed upright portion of said pedestal, and said upper member comprises an integrally formed lower portion of said standard means.

21. An appliance according to claim 19 wherein said upright portion defines said yoke portion, said upper member defines a cavity open on one side and at a bottom end, said cavity receives and substantially encloses said upright portion, and said pin portion is disposed in said cavity.

22. An appliance according to claim 21 wherein said upright portion has a pair of side walls; said yoke portion comprises a pair of yokes, one formed by a slot in an upper edge of each of said side walls; and said pin portion comprises a pair of axially aligned pins having inner ends separated and outer ends extending, respectively, from opposing surfaces of said cavity; and each of said pins is pivotally supported by a different one of said yokes.

23. An appliance according to claim 22 wherein said upright portion comprises front and rear walls joining said side walls, said arm portion is formed on an upper end of said rear wall, and said catch means extends from said arm portion into regions between said slots when in said latched position.

24. An electrical appliance comprising:

base means;

electrical load means mounted on said base means;

electrical control means supported by said base means and movable into a plurality of different positions each effecting a predetermined control function of said load means;

actuator means manually movable in one sense between active and inactive positions, said actuator means in said active position being coupled to said control means and manually movable in a different sense than said one sense to move said control means between said different positions, and said actuator means in said inactive position being decoupled from said control means so as to be incapable of producing movement thereof between said different positions; and indicator means functional to indicate the said different position occupied by said control means, said indicator means functioning independently of said movement of a different sense with said actuator means in said inactive position.

25. An appliance according to claim 24 wherein said indicator means comprises a first indicator portion fixed to said base means and a second indicator portion coupled to said control means and arranged to indicate the position thereof with respect to said first indicator portion.

26. An appliance according to claim 31 wherein said actuator means comprises a first member keyed to said control means and rotatable to produce movement thereof between said different positions, a second member movable in a linear sense between said active and inactive positions, and said second member in said active position is keyed to said first member and rotatable to produce said rotatable movement thereof and in said inactive position is decoupled from said first member so as to be incapable of producing said rotatable movement thereof.

27. An appliance according to claim 26 wherein said first member comprises a first annular gear, said second member comprises a second annular gear, said first and second gears are axially spaced apart with said second member in said inactive position and are operatively engaged with said second member in said active position.

28. An appliance according to claim 27 wherein said second indicator portion is an outwardly projecting arcuate portion of said first gear, said first indicator portion is a wall portion covering said arcuate indicator portion, and said wall portion defines spaced apart holes aligned with said arcuate indicator portion such that rotational movement of said arcuate indicator portion is visible through said holes.

29. A control comprising:

housing means comprising wall means;

activator means for effecting a control function and mounted within said housing means on one side of said wall means;

first actuator means coupled to said activator means and movable to control operation thereof;

second actuator means coupled to said first actuator means and adapted for manual manipulation from an opposite side of said wall means between active and inactive positions, said second actuator means in said active position rendering said first actuator means functional to control operation of said activator means and in said inactive position rendering said first actuator means dysfunctional to control operation of said activator means;

bias means biasing said second actuator means in said inactive position; and latch means mounted and accessible on said opposite side of said wall means and manually movable between latched and unlatched positions each maintainable without applied manual force, said latch means in said latched position overcoming said bias means to latch said second actuator means in said active position and in said unlatched position allowing said bias means to move said second actuator means into said inactive position.

30. A control according to claim 29 wherein said second actuator means is further adapted for manual manipulation in said active position to induce movement of said first actuator means and thereby control operation of said activator means.

31. A control according to claim 30 wherein said second actuator means is movable in one sense between said active and inactive positions and is movable in a different sense to induce said movement of said first actuator means.

32. A control according to claim 31 wherein said latch means in said latched position engages said second actuator means to prevent said movement in said one sense.

33. An appliance according to claim 32 wherein said one sense of movement is linear, and said different sense of movement is rotational.

34. A control comprising;

activator means for effecting a control function;

first actuator means coupled to said activator means and movable to control operation thereof;

second actuator means coupled to said first actuator means and adapted for manual manipulation between active and inactive positions, said second actuator means in said active position rendering said first actuator means functional to control operation of said activator means and in said inactive position rendering said first actuator means dysfunctional to control operation of said activator means;

bias means biasing said second actuator means in said inactive position; and latch means manually movable between latched and unlatched positions each maintainable without applied manual force, said latch means in said latched position overcoming said bias means to latch said second actuator means in said active position and in said unlatched position allowing said bias means to move said second actuator means into said inactive position, and wherein said latch means in said latched position prevents movement of said second actuator means into said inactive position.

35. A control according to claim 34 wherein said second actuator means is further adapted for manual manipulation in said active position to induce movement of said first actuator means and thereby control operation of said activator means.

36. A control according to claim 36 wherein said second actuator means is movable in one sense between said active and inactive positions and is movable in a different sense to induce said movement of said first actuator means.

37. A control according to claim 36 wherein said latch means in said latched position engages said second actuator means to prevent said movement in said one sense.

38. An appliance according to claim 37 wherein said one sense of movement is linear, and said different sense of movement is rotational.

* * * * *